US005894292A

United States Patent [19]

Everest, III et al.

[11] Patent Number: 5,894,292

[45] Date of Patent: Apr. 13, 1999

[54] ANTENNA ASSEMBLY FOR A PORTABLE COMMUNICATIONS DEVICE

[75] Inventors: David Clark Everest, III, Tamarac; Frank M. Tyneski, Fort Lauderdale; Alex Marron, Plantation; Sam Hosseini, Weston, all of Fla.

[73] Assignee: Motorola, Inc., Schaumburg, Ill.

[21] Appl. No.: 08/762,088

[22] Filed: Dec. 9, 1996

[51] Int. Cl.[6] ..... H01Q 1/24; H01Q 1/36

[52] U.S. Cl. ..... 343/895; 343/702; 336/749; 336/192; 336/185

[58] Field of Search ..... 343/702, 895; 336/749, 192, 185

[56] References Cited

U.S. PATENT DOCUMENTS

| | | | |
|---|---|---|---|
| 3,585,553 | 6/1971 | Muckelroy | 336/192 |
| 3,641,580 | 2/1972 | Monser | 343/895 |
| 4,170,014 | 10/1979 | Sully | 343/749 |
| 4,644,366 | 2/1987 | Scholz | 343/895 |
| 4,912,448 | 3/1990 | Katayama et al. | 336/192 |
| 5,119,107 | 6/1992 | Wildey et al. | 343/770 |
| 5,359,340 | 10/1994 | Yokota | 343/895 |

*Primary Examiner*—Anita Pellman Gross
*Assistant Examiner*—Daniel St. Cyr
*Attorney, Agent, or Firm*—Frank M. Scutch, III

[57] ABSTRACT

An antenna assembly (100) includes a substrate (101) having a notched portion (103) and one or more attachment apertures (105). An antenna (107) includes a conductive coil (109) that is inserted within the slotted portion of the substrate (101) such that a loop of the conductive coil (109) is fastened within the attachment aperture (105) for holding the antenna (107) into a fixed position. The antenna assembly (100) for a low cost and easy method of assembly that rigidly attaches an antenna to a substrate without the need for additional mechanical fasteners.

12 Claims, 3 Drawing Sheets

ANTENNA ASSEMBLY FOR A PORTABLE COMMUNICATIONS DEVICE

TECHNICAL FIELD

This invention relates in general to antennas and more particularly antenna assemblies used with portable communications devices.

BACKGROUND

The new family radio service (FRS) is a portion of radio spectrum allotted by the Federal Communications Commission (FCC) and is intended to be used for narrow band frequency modulation (FM) two-way radio communication. The allotted frequencies in the FRS allow average consumers, buying the appropriate two-way radio products, to operate license free within this band. Consequently, this readily allows a consumer to purchase two or more FRS radios that can be easily used in various operating environments and conditions such during vacations, sporting events and/or emergencies.

While offering license free operation, the FCC has also mandated certain requirements for two-way radio manufacturers producing radio products for the FRS. Thus, this regulatory mandate had imposed requirements that were previously unnecessary on other consumer or industrial type two-way radio products. One such requirement pertains to the antenna used on the FRS two-way radio. Among other things, this requirement specifies that the antenna shall be incapable of being removed or changed by the operator. Therefore, in view of this new regulation, a novel and unique antenna attachment structure will be required. As is well know in the art, other commercially available two-way radio products most often include a removable antenna, generally with some type of threaded or twist-on attachment.

Additional considerations for the radio manufacturer also include low cost and ease of assembly. For low price consumer products made for the FRS, it is important to maintain low material and manufacturing costs. With this in mind, a number of antenna performance considerations are also at issue since there is an additional regulatory requirement that the maximum effective radiated power (ERP) of the FRS two-way radio not exceed one-half watt. This requires the antenna gain of the FRS antenna be very efficient with a minimum current drain on the on-board batteries. Moreover, two way radio antennas typically can be lossy in the ultra high frequency (UHF) range since they are often required to meet very stringent mechanical requirements. In general, these antennas will have no better than −6 dBi to −8 dBi gain.

For these reasons, there is a need for a new antenna assembly the can be used with FRS radios and other consumer two-way radio products that is not removable yet is easily to manufacture and assemble.

DETAILED DESCRIPTION OF THE PREFERRED EMBODIMENT

Figure 1:
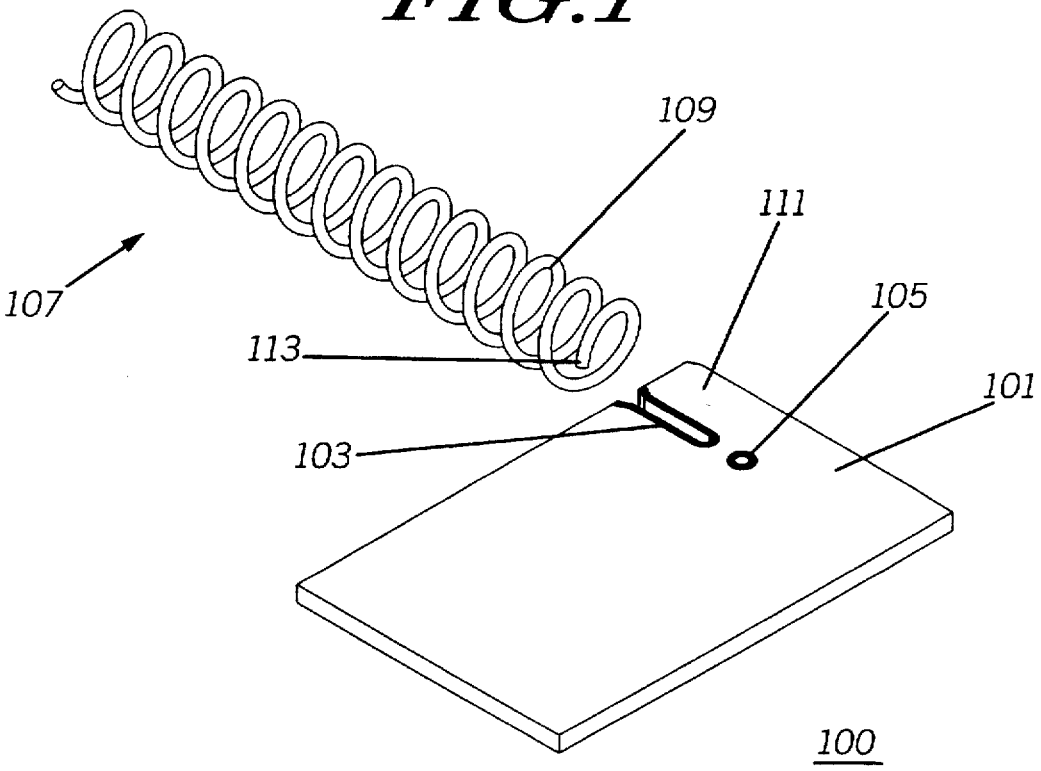
FIG. 1 is an explode view of the antenna assembly having an open slotted section in accordance with a first embodiment of the invention.

Referring now to FIG. 1, an antenna assembly 100 for use with a portable communications device such as a radio receiver or two-way radio transceiver includes a substantially rectangular substrate 101 having one or more open slotted or notched portions 103 and one or more apertures 105. As will be recognized by those skilled in the art, substrate 101 is manufactured of fire-retarding epoxy resin/glass cloth laminate (FR-4), but other compounds such as bismaleimide/triazine (BT) or polyimide may also be used. The open notched portion 103 extends from an edge of the substrate 101 to some predetermined point at the interior of the substrate. The aperture 105 is preferably a circular hole or opening located substantially adjacent to the closed end of the open notched portion 103.

The antenna assembly 100 further includes an antenna 107 that is formed using a helical coil 109 preferably with a uniform pitch and wire diameter. As will be evident to those skilled in the art, the helical coil is a rigid structure preferably made of copper plated steel wire or some other form of highly electrically conductive material that is formed into a plurality of loops. An antenna radiator (not shown) may also be further attached to an upper section of the helical coil 109 to provide an effective radiator for radio frequency (RF) energy emitted by the portable communications device.

Figure 2:
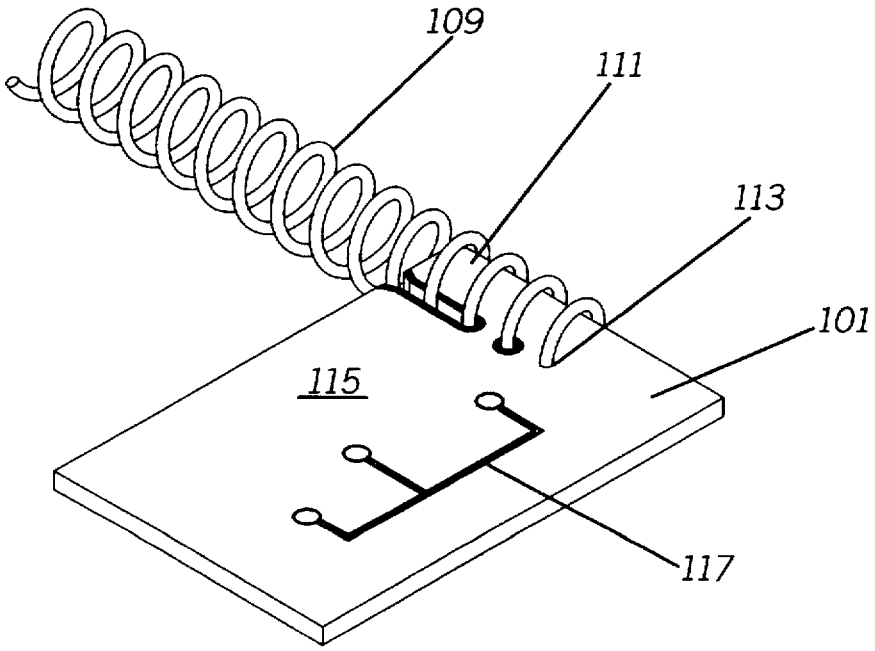
FIG. 2 is an assembled view of the antenna assembly shown in FIG. 1.

As seen in FIG. 2, the helical coil 109 is positioned over a finger 111 formed by an edge of the substrate 101 and edge of the open notched portion 103. the helical coil 109 is moved into the slot formed by open notched portion 103 wherein it is then rotated to a position such that an end 113 of the helical coil 109 is moved through the aperture 105. The helical coil 109 is rotated until the end 113 contact the surface 115 of the substrate 101. This allows the helical coil 109 and an attached antenna 107 to be easily assembled and held in a substantially fixed position without the use of additional mechanical attachment devices. While in this position, the helical coil can be electrically attached using, a solder reflow process or otherwise, to a metal trace of runner 117 located on the substrate 101

Figure 3:
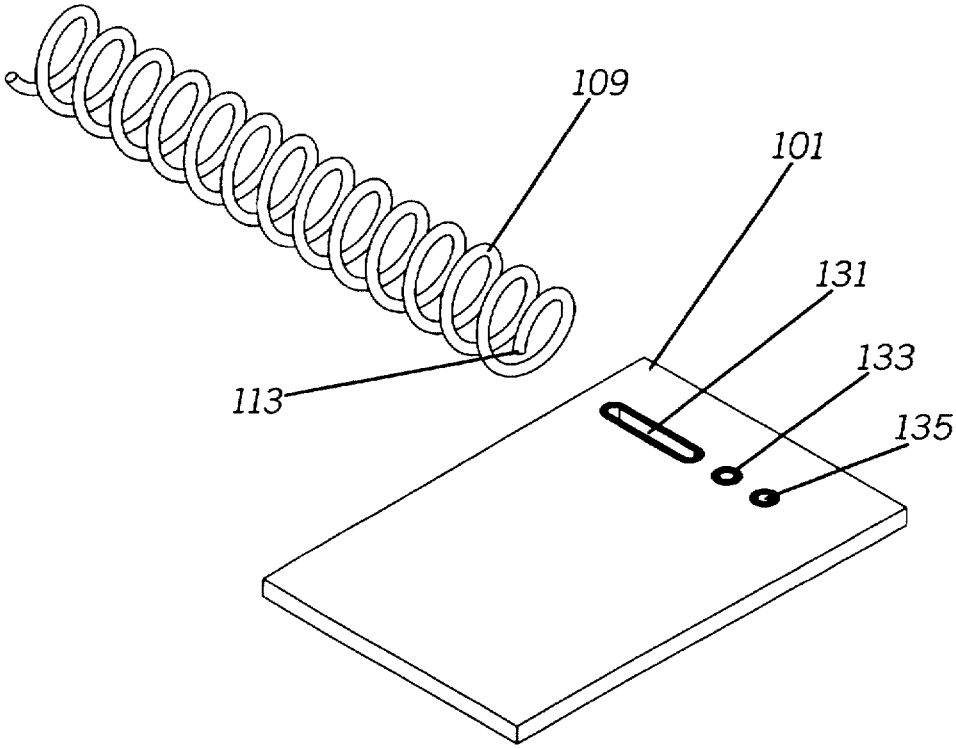
FIG. 3 is an exploded view of the antenna assembly having a closed slotted section in accordance with a second embodiment of the invention.
Figure 4:
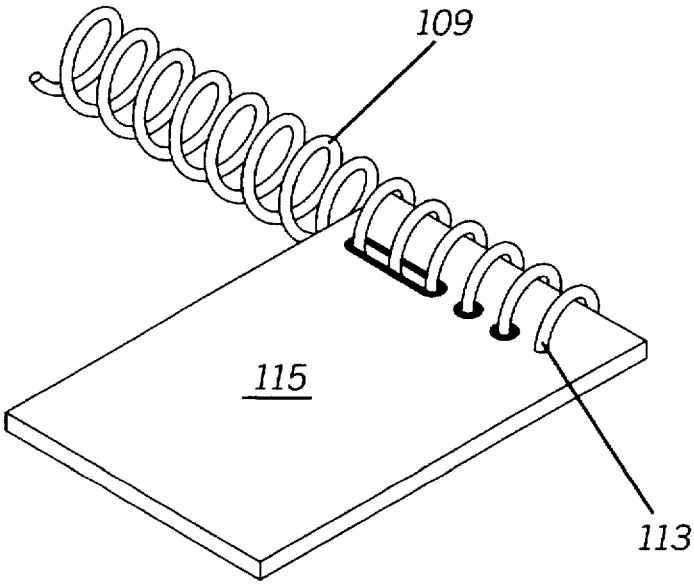
FIG. 4 is an assembled view of the antenna assembly shown in FIG. 3.

A second embodiment of the invention is shown in FIGS. 3 and 4 where the end 113 of the helical coil 109 in inserted into a closed notched portion 131. It is then subsequently rotated so as a loop of the helical coil is engaged within aperture 133 and aperture 135 respectively where finally the edge 113 makes contact with the surface 115 of the substrate 101. As with the first embodiment shown in FIGS. 1 and 2, the coil can then be electrically attached to a metal trace or runner (not shown) located on the substrate for use with components used in the portable communications device. This embodiment also offers the benefit of easily attaching the helical coil 109 i.e. antenna 107 to an electrical substrate without the need for specialized mechanical hardware that would increase the overall product cost.

Figure 5:
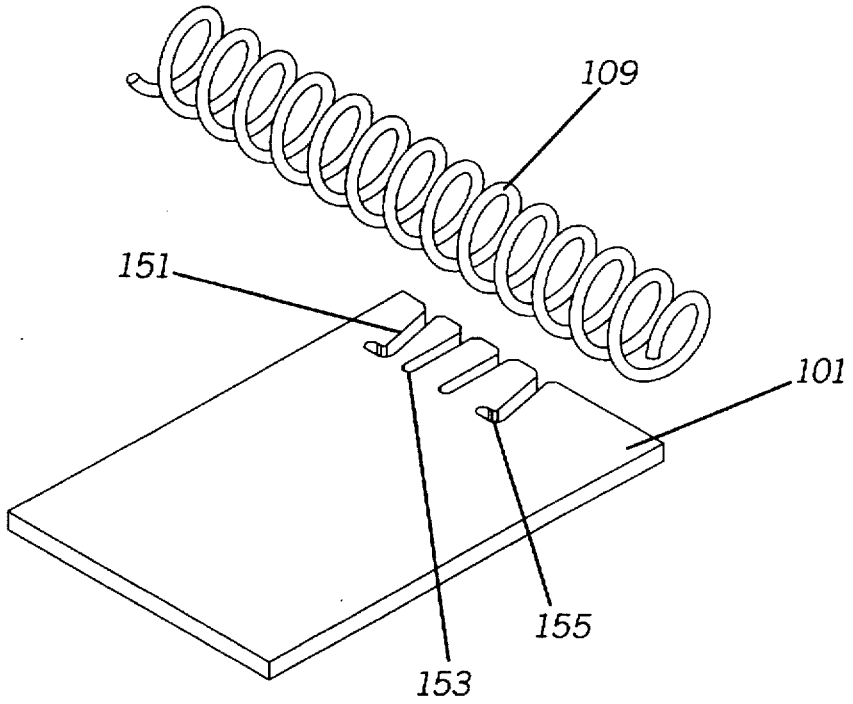
FIG. 5 is an exploded view of the antenna assembly having an open slotted section without an accompanying aperture according to a third embodiment of the invention.
Figure 6:
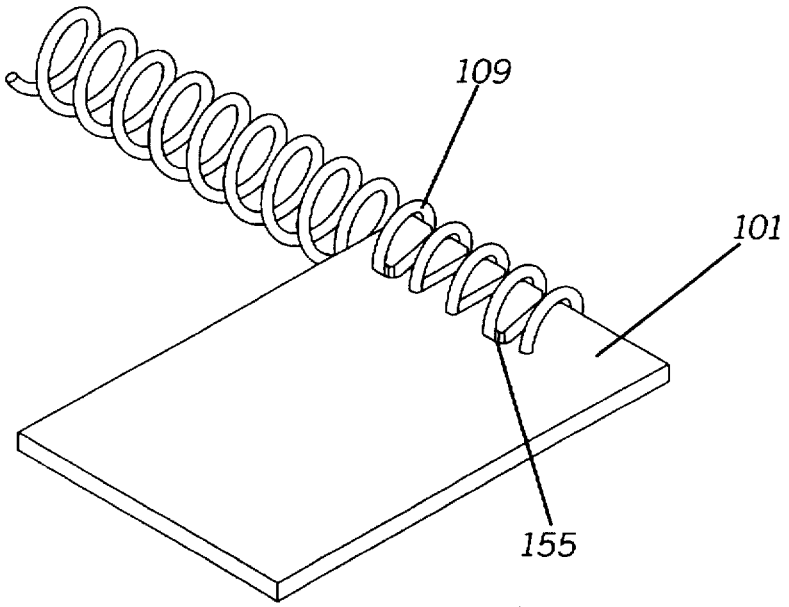
FIG. 6 is an assembled view of the antenna assembly shown in FIG. 5.

In FIGS. 5 and 6, a plurality of slotted sections 151 are cut into the substrate 101. The position and spacing of the slotted section preferably will be substantially identical to the pitch of the loops forming the helical coil 109. During assembly, a respective loop is inserted into the respective slotted section. Optionally, the slotted sections 151 may include an locking portion 155 or may be substantially straight channel-like shape 153. The loops of helical coil 109 are inserted into the slotted sections 151. Thereafter, the helical coil 109 can moved such that the respective loops of the coil are forced into the locking portion 155. This enables the helical coil 109 to be held into a substantially fixed position, without the need for additional locking or mechanical fasteners. Moreover, the helical coil 109 can then be electrical attached or solder reflowed to metal traces or runners (not shown) on the printed circuit board.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. An antenna assembly comprising:

a substrate having a slotted portion and at least one attachment aperture;

an antenna comprised of a conductive coil having a plurality of loops; and wherein the slotted portion of the substrate has at least one open end that is open to an edge of the substrate and is inserted within the conductive coil such that at least one loop of the plurality of loops is fastened within the at least one attachment aperture for holding the antenna into a fixed position.

2. An antenna assembly as in claim 1 wherein the substrate includes at least one conductive trace for making an electrical connection with the conductive coil.

3. An antenna assembly as in claim 1 wherein the conductive coil is a wire having a uniform pitch and wire diameter.

4. An antenna assembly as in claim 1 wherein the slotted portion is enclosed within the substrate.

5. An antenna assembly used in a portable two-way radio comprising:

an antenna element forming a helical coil;

a printed circuit board having at least one slotted section and at least one aperture where the at least one slotted section is open to an edge of the printed circuit board; and wherein an end of the helical coil is inserted into the at least one slotted section and rotated for engaging the end of the helical coil with the at least one aperture and holding the antenna element into a fixed position.

6. An antenna assembly as in claim 5 wherein the helical coil is made of a conductive material.

7. An antenna assembly as in claim 5 wherein the printed circuit board includes at least one metal trace for electrically connecting with the helical coil.

8. An antenna assembly for use in a portable communications device comprising:

a substrate having a plurality of slotted sections open to an edge of the substrate and at least one engagement section formed within one of the plurality of slotted sections;

an antenna element including a helical coil having a plurality of loops; and wherein at least one of the plurality of loops is positioned into at least one of the plurality of slotted sections and engages with the at least one engagement section for fixedly attaching the antenna element with the substrate.

9. An antenna assembly as in claim 8 wherein the substrate includes a plurality of metal traces for connection to the helical coil.

10. An antenna assembly as in claim 8 wherein the helical coil has a uniform pitch and wire diameter.

11. A method of attaching an antenna to a substrate having at least one slotted section open to an edge of the substrate and at least one aperture for use in a portable communications device comprising the steps of:

positioning an antenna element having a helical coil into the at least one slotted section located on the substrate; and rotating the helical coil so that an end of the helical coil is disposed within the at least one aperture for engaging the helical coil with the substrate and holding the antenna element into a fixed position.

12. A method as in claim 11 wherein the at least one slotted section is enclosed within the substrate.

* * * * *